US010653240B2

(12) United States Patent
Goetz

(10) Patent No.: US 10,653,240 B2
(45) Date of Patent: May 19, 2020

(54) FURNITURE DRIVE

(71) Applicant: Julius Blum GmbH, Hoechst (AT)

(72) Inventor: Christof Goetz, Lustenau (AT)

(73) Assignee: JULIUS BLUM GMBH, Hoechst (AT)

( * ) Notice: Subject to any disclaimer, the term of this patent is extended or adjusted under 35 U.S.C. 154(b) by 0 days.

(21) Appl. No.: 16/130,376

(22) Filed: Sep. 25, 2018

(65) Prior Publication Data

US 2019/0008276 A1 Jan. 10, 2019

Related U.S. Application Data

(63) Continuation of application No. PCT/AT2017/060023, filed on Feb. 9, 2017.

(30) Foreign Application Priority Data

Apr. 5, 2016 (AT) ..... A 50274/2016

(51) Int. Cl.
*A47B 88/46* (2017.01)
*A47B 88/467* (2017.01)
(Continued)

(52) U.S. Cl.
CPC ..... *A47B 88/46* (2017.01); *A47B 88/467* (2017.01); *A47B 88/473* (2017.01); *E05F 1/16* (2013.01);
(Continued)

(58) Field of Classification Search
CPC ..... A47B 88/40; A47B 88/46; A47B 88/467; A47B 88/473; E05F 1/16
(Continued)

(56) References Cited

U.S. PATENT DOCUMENTS 4,025,138 A 5/1977 Kittle
7,171,099 B2 1/2007 Barnes et al.
(Continued)

FOREIGN PATENT DOCUMENTS

CN 1813210 8/2006
CN 103889270 6/2014
(Continued)

OTHER PUBLICATIONS

International Search Report dated Oct. 11, 2017 in International (PCT) Application No. PCT/AT2017/060023.
(Continued)

*Primary Examiner* — James O Hansen
(74) *Attorney, Agent, or Firm* — Wenderoth, Lind & Ponack, L.L.P.

(57) ABSTRACT

A furniture drive includes an entrainment member for retracting a movable furniture part into a closed position, and the entrainment member is displaceably mounted in sections along a linear travel path and can be detachably coupled to the movable furniture part. A spring device applies force to the entrainment member in a retraction direction, and a damping device damps movement of the entrainment member in the retraction direction. The damping device includes a fluid chamber and a ram which is displaceably mounted relative to the fluid chamber. A holding device is arranged between the ram and the entrainment member, and the holding device holds the ram relative to the entrainment member. The ram is movable through an opening of the holding device when a force acting upon the entrainment member in the retraction direction is exceeded, whereby the entrainment member can be decoupled from the ram.

17 Claims, 5 Drawing Sheets

(51) Int. Cl.
*A47B 88/473* (2017.01)
*E05F 1/16* (2006.01)

(52) U.S. Cl.
CPC ... *A47B 2210/0091* (2013.01); *E05Y 2800/24* (2013.01); *E05Y 2900/20* (2013.01)

(58) Field of Classification Search
USPC ..... 312/330.1, 333, 334.1, 334.7, 334.8, 312/319.1, 319.2
See application file for complete search history.

(56) References Cited

U.S. PATENT DOCUMENTS

| | | | | |
|---|---|---|---|---|
| 7,308,184 | B2 | 12/2007 | Barnes et al. | |
| 7,472,973 | B2 | 1/2009 | Huang | |
| 7,499,623 | B2 | 3/2009 | Barnes et al. | |
| 7,854,485 | B2 | 12/2010 | Berger | |
| 7,869,683 | B2 | 1/2011 | Barnes et al. | |
| 8,027,558 | B2 | 9/2011 | Barnes et al. | |
| 8,136,898 | B2 | 3/2012 | Ruter | |
| 8,639,081 | B2 | 1/2014 | Barnes et al. | |
| 8,905,498 | B2 | 12/2014 | Hammerle | |
| 9,167,897 | B2 | 10/2015 | Barnes et al. | |
| 9,211,007 | B2 | 12/2015 | Brunnmayr et al. | |
| 9,565,938 | B2 | 2/2017 | Barnes et al. | |
| 9,820,573 | B2 | 11/2017 | Brunnmayr | |
| 9,844,266 | B2 | 12/2017 | Barnes et al. | |
| 10,226,123 | B2 | 3/2019 | Barnes et al. | |
| 2005/0025444 | A1 | 2/2005 | Barnes et al. | |
| 2007/0098347 | A1 | 5/2007 | Barnes et al. | |
| 2007/0132346 | A1 | 6/2007 | Huang | |
| 2008/0069512 | A1 | 3/2008 | Barnes et al. | |
| 2009/0072687 | A1* | 3/2009 | Fitz | E05F 1/105 312/319.5 |
| 2009/0226142 | A1 | 9/2009 | Barnes et al. | |
| 2009/0273263 | A1 | 11/2009 | Berger | |
| 2009/0309470 | A1 | 12/2009 | Ruter | |
| 2011/0110639 | A1 | 5/2011 | Barnes et al. | |
| 2012/0012713 | A1 | 1/2012 | Barnes et al. | |
| 2013/0088132 | A1 | 4/2013 | Hammerle | |
| 2013/0249367 | A1 | 9/2013 | Chen | |
| 2014/0210329 | A1 | 7/2014 | Brunnmayr | |
| 2014/0246969 | A1 | 9/2014 | Barnes et al. | |
| 2015/0098667 | A1 | 4/2015 | Brunnmayr et al. | |
| 2015/0374123 | A1* | 12/2015 | Goetz | E05B 64/462 312/319.1 |
| 2015/0377269 | A1 | 12/2015 | Haemmerle | |
| 2016/0198854 | A1 | 7/2016 | Barnes et al. | |
| 2017/0208943 | A1 | 7/2017 | Barnes et al. | |
| 2018/0168342 | A1 | 6/2018 | Barnes et al. | |
| 2019/0261774 | A1 | 8/2019 | Barnes et al. | |

FOREIGN PATENT DOCUMENTS

| | | |
|---|---|---|
| CN | 104427907 | 3/2015 |
| CN | 105143689 | 12/2015 |
| CN | 105358784 | 2/2016 |
| CN | 105433615 | 3/2016 |
| DE | 20 2005 009 860 | 5/2006 |
| DE | 20 2007 001 897 | 10/2007 |
| DE | 20 2009 005 433 | 8/2009 |
| EP | 1 625 810 | 2/2006 |
| EP | 2 241 219 | 10/2010 |
| EP | 2 457 465 | 5/2012 |
| JP | 3129758 | 2/2007 |
| WO | 2006/066774 | 6/2006 |
| WO | 2011/150432 | 12/2011 |

OTHER PUBLICATIONS

Search Report dated Dec. 29, 2016 in Austrian Application No. A 50274/2016, with English translation.

* cited by examiner

FURNITURE DRIVE

BACKGROUND OF THE INVENTION

The present invention relates to a furniture drive for retracting a movably-supported furniture part into a closed end position relative to a furniture carcass. The furniture drive includes: an entrainment member for retracting the movable furniture part, wherein the entrainment member is displaceably arranged at least over a region along a linear displacement path and can be releasably coupled to the movable furniture part, a spring device for applying a force to the entrainment member in a retracting direction, a damping device for dampening a movement of the entrainment member in the retracting direction, in which the damping device includes a fluid chamber and a ram displaceably arranged relative to the fluid chamber, and a holding device arranged between the ram and the entrainment member, in which the holding device holds the ram relative to the entrainment member.

The invention further concerns a drawer pull-out guide comprising a furniture drive of the type to be described.

DE 20 2005 009 860 U1 discloses a closing and retracting device for drawers, in which an entrainment member adapted to be coupled to the drawer is releasably coupled to a spherical head of a coupling rod. The spherical head of the coupling rod thereby engages into a receiving portion of the entrainment member, and the receiving portion of the entrainment member, under the influence of a pulling force exerted to the drawer, expands elastically and thereby releases the spherical head in an overload case. For this overload coupling, there is, however, sufficient space available, because the entrainment member, upon an unduly large pulling force applied to the drawer, moves in the extension direction and thus the distance between the entrainment member and the coupling rod is enlarged.

SUMMARY OF THE INVENTION

It is an object of the present invention to propose a furniture drive of the type mentioned in the introductory part, in which damage to the furniture drive, in particular to the damping device, can be prevented in an overload case.

According to the invention, the ram, when a force exertion applied to the entrainment member in the retracting direction is exceeded, can be moved through an opening of the holding device, whereby the entrainment member can be decoupled from the ram.

In other words, the holding device is configured as a linearly operating overload coupling which, when a force exertion to the entrainment member in the retracting direction exceeds a threshold value (i.e. when the movable furniture part is being catapulted with an unduly large manual force or violently slammed towards the closing direction), a decoupling between the entrainment member and the ram is brought about. The ram, upon such an unduly large force application, moves through an opening of the holding device and a continued, destruction-free translational movement of the ram relative to the entrainment member takes place. In this way, the risk of damage (in particular a burst of the damper housing and a leakage of a damping medium as a result of the unduly large pressure application) caused by an entrainment member moving into the furniture carcass can be prevented.

Preferably the ram, also when a force exertion to the entrainment member in a direction opposite the retracting direction is exceeded, can be moved through a further opening of the holding device, whereby the entrainment member can be decoupled from the ram. In other words, decoupling of the ram from the entrainment member can be effected both in an overload case acting in the retraction direction and also in an extension direction of the entrainment member.

The holding device can include at least one holding element which holds the ram relative to the holding device below a predetermined application of force applied to the entrainment member, and which allows a destruction-free translational movement of the ram relative to the entrainment member above a predetermined application of force applied to the entrainment member. Thereby, the at least one holding element can be acted upon by an energy storage member. That energy storage member can be constituted, for example, of a mechanical spring element or, alternatively, of an intrinsic elasticity of the holding element.

The drawer pull-out guide according to the invention comprises a carcass rail to be fixed to a furniture carcass and at least one extension rail displaceably arranged relative to the carcass rail between a closed position and an open position, and a furniture drive of the described type for retracting the extension rail into the closed position.

BRIEF DESCRIPTION OF THE DRAWINGS

Further details and advantages of the invention will be explained with the aid of the following description of figures; in which.

DETAILED DESCRIPTION OF THE INVENTION

Figure 1:
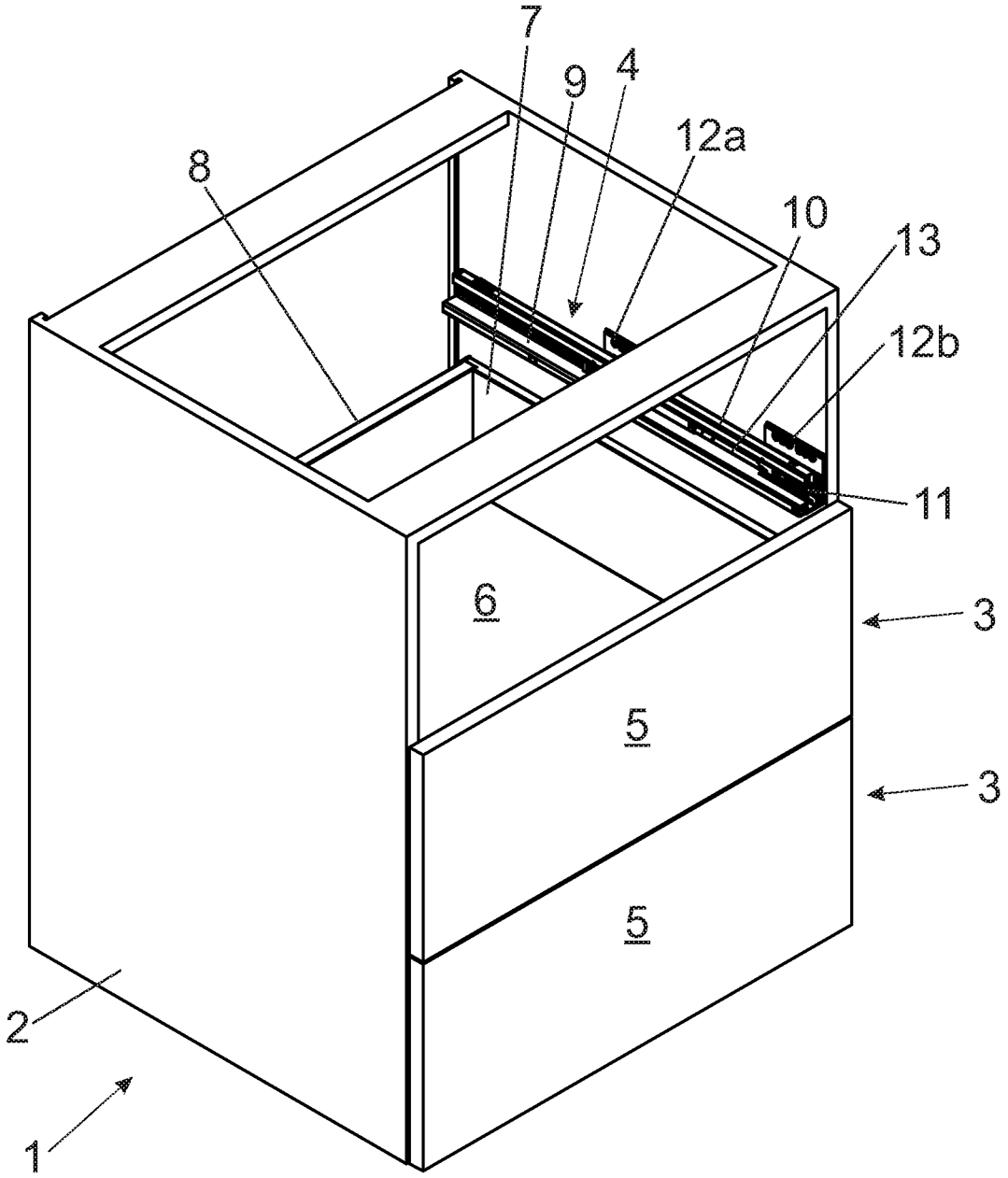
FIG. 1 is a perspective view of an item of furniture having a furniture carcass and drawers displaceably arranged relative thereto.

FIG. 1 shows an item of furniture 1 with a cupboard-shaped furniture carcass 2, in which movable furniture parts 3 in the form of drawers are displaceably arranged relative to the furniture carcass 2 by drawer pull-out guides 4. The drawers each have a front panel 5, a drawer base 6, drawer side walls 7 and a rear wall 8. The drawer pull-out guides 4 each have a carcass rail 9 to be fixed to the furniture carcass 2 by fastening portions 12*a*, 12*b*, and at least one extension rail 10 displaceably arranged relative to the carcass rail 9 and which is to be connected to the drawer side wall 7. Optionally, a central rail 11 is displaceably arranged between the carcass rail 9 and the extension rail 10 in order for a full extension of the drawer to be realized. The drawer pull-out guide 4 further includes a furniture drive 13 by which the extension rail 10, at the end of the closing movement, can be retracted by a force of a spring device 17 (FIG. 2), and wherein this spring-assisted retraction movement can be decelerated by a damping device 19 of the furniture drive 13.

Figure 2:
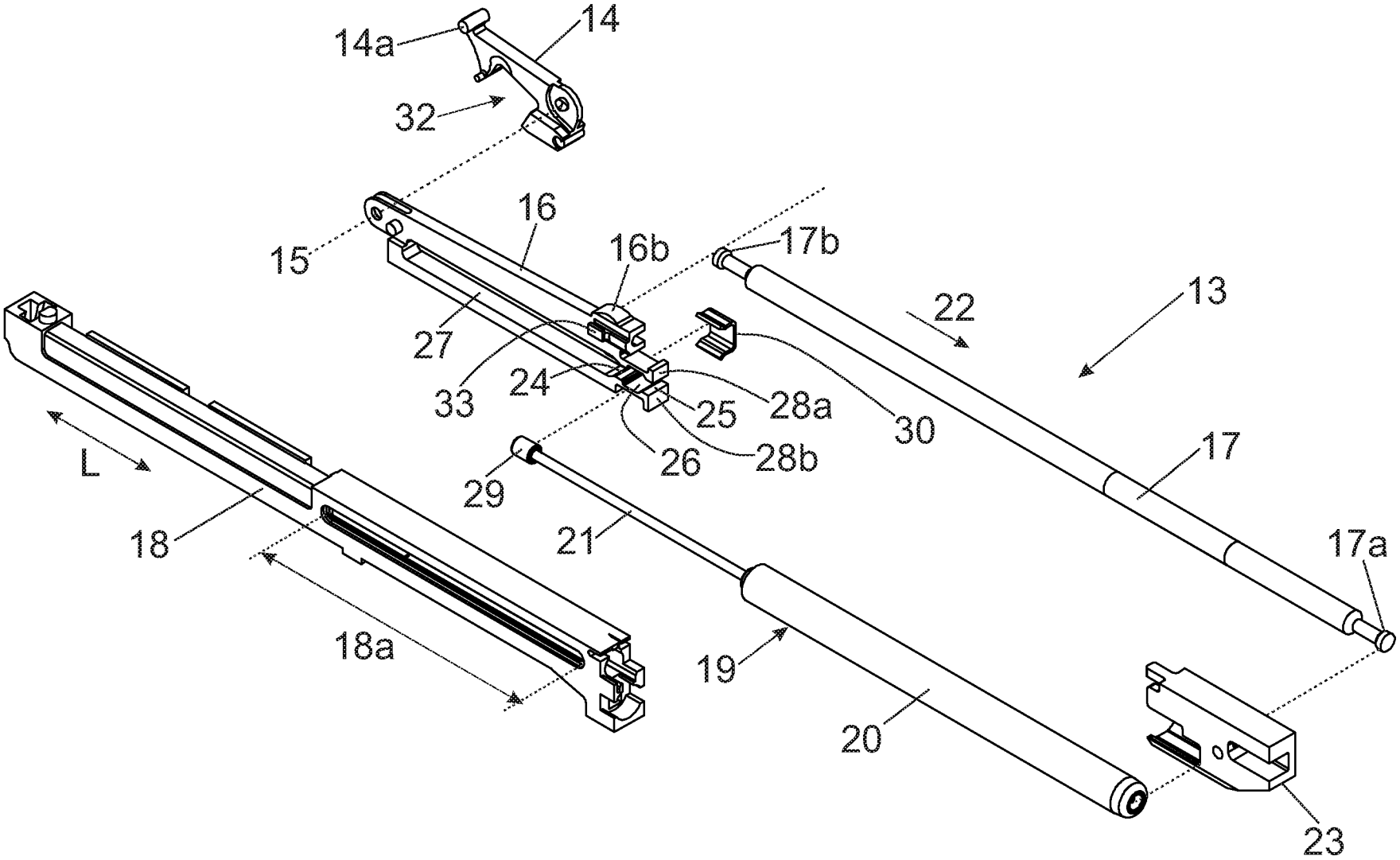
FIG. 2 is an exploded view of an exemplary embodiment of a furniture drive.

FIG. 2 shows an exemplary embodiment of a furniture drive 13 in an exploded view. The furniture drive 13 includes a housing 18, in which an entrainment member 14 pivotally arranged about a pivoting axis 15 is arranged for releasably coupling to the movable furniture part 3. The entrainment member 14 is displaceably arranged along a linear displacement path 31*a* (FIG. 3*a*) extending in a longitudinal direction (L) of the housing 18.

For applying a force to the entrainment member 14 in a retraction direction 22, a spring device 17 (preferably with at least one tension spring) is provided by which the entrainment member 14 and the movable furniture part 3 coupled therewith, respectively, can be retracted in the retraction direction 22. The spring device 17 has a first fastening location 17*a* which, in a mounting position, is connected to a stationary bearing portion 23. The second fastening location 17*b* of the spring device 17 is connected to a bearing 16*b* of a holding device 16 which is connected to the entrainment member 14 by the pivoting (hinge) axis 15. The holding device 16 includes at least one guide element 33 by which the holding device 16, together with the entrainment member 14, is displaceably arranged relative to the housing 18 along a guide track 18*a*. For dampening a spring-assisted retraction movement of the entrainment member 14 in the retraction direction 22, a damping device 19 in the form of a linear damper is provided. The linear damper has a fluid chamber (cylinder) 20 and a ram (piston) 21 in the form of a piston rod movable relative to the fluid chamber 20. The fluid chamber 20 is formed within a fluid cylinder which, in the mounting position, is also connected with an end portion to the bearing portion 23. The holding device 16 arranged between the ram 21 and the entrainment member 14 is provided for releasably holding the ram 21 relative to the entrainment member 14, so that when a force applied to the entrainment member 14 in the retraction direction 22 exceeds a threshold value, the ram 21 can be moved through an opening 24 of the holding device 16, whereby the entrainment member 14 can be decoupled from the ram 21.

In the shown figure, the holding device 16 includes two holding elements 28*a* and 28*b* which delimit a receiving chamber 26 for accommodating a coupling portion 29 of the ram 21. By an energy storage member 30 which, in the shown embodiment, is configured as a spring clip made of spring steel embracing the two holding elements 28*a*, 28*b*, the coupling portion 29 of the ram 21 is held in position within the receiving chamber 26. The coupling portion 29 formed or arranged on the ram 21 has a greater diameter than the ram 21, and the coupling portion 29, during a normal operation (i.e. below a predetermined force exertion applied to the entrainment member 14) is held in the receiving chamber 26 of the holding device 16 and therewith ensures that the coupling between the holding device 16 and the ram 21 is maintained. When a force exertion applied to the entrainment member 14 in the retraction direction 22 is exceeded, the coupling portion 29 of the ram 21 can be moved through an opening 24 of the holding device 16, so that the entrainment member 14 can be decoupled from the ram 21. In the shown embodiment, when a force exertion applied to the entrainment member 14 in the retraction direction 22 is exceeded, the coupling portion 29 can move into a bypass channel 27 of the holding device 16, and a longitudinal direction of the bypass channel 27 extends coaxially to a longitudinal direction of the ram 21. The bypass channel 27 is, however, not mandatorily required. It would also be sufficient to allow the coupling portion 29 of the ram 21 to move from the receiving chamber 26 in an open space being present laterally besides the receiving chamber 26.

On the contrary, when a force exertion applied to the entrainment member 14 in a direction opposite the retraction direction 22 is exceeded, the coupling portion 29 of the ram 21 can move through a further opening 25 of the holding device 16, so that the entrainment member 14 can be decoupled from the ram 21. In the overload case acting in a direction opposite the retraction direction 22 (i.e. upon an unduly large pulling force applied to the movable furniture part 3 in the opening direction), the coupling portion 29 moves out from the receiving chamber 26 into an open space being present laterally besides the receiving chamber 26. As a result, the coupling portion 29 subsequently enlarges its distance to the holding device 16. By moving the movable furniture part 3, the entrainment member 14 and the ram 21 can again be moved towards one another, so that the ram 21 again enters the receiving chamber 26 and the coupling between the ram 21 and the holding device 16 is again established.

Figure 3A:
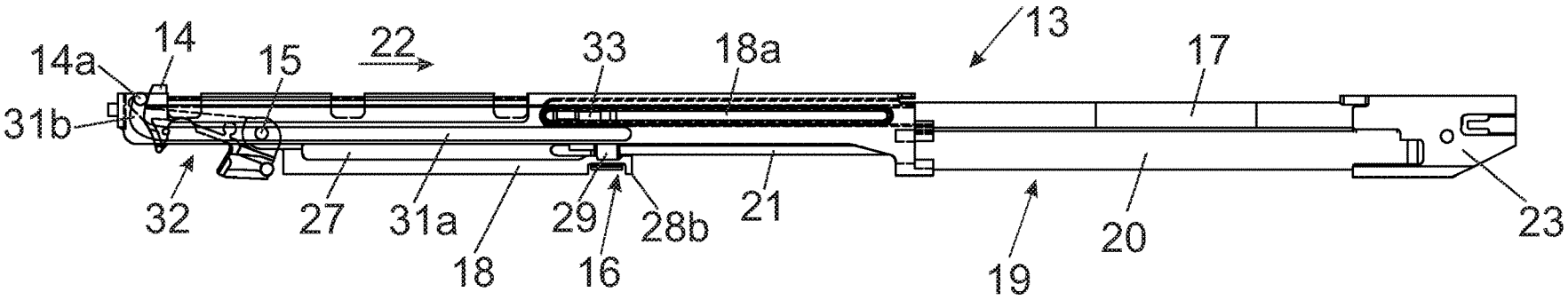
FIG. 3*a*, 3*b* show the furniture drive in a side view and in a perspective view.
Figure 3B:
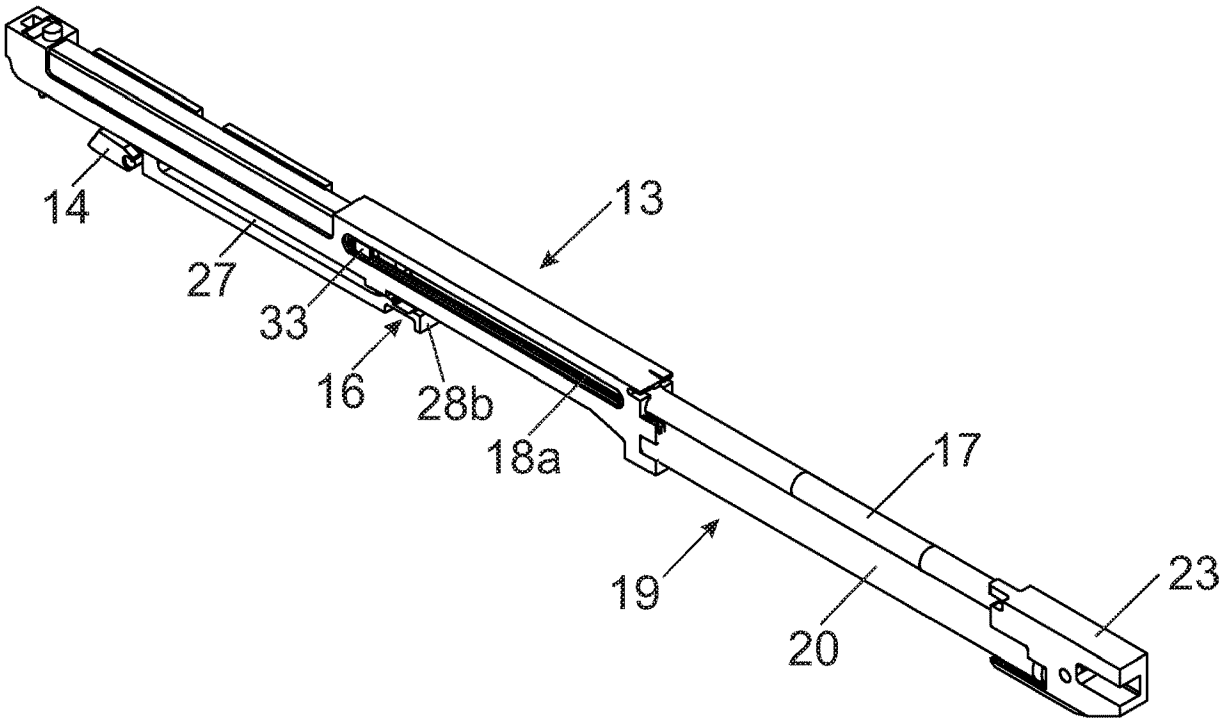

FIG. 3*a* shows the furniture drive 13 in a side view, in which the entrainment member 14 arranged within the housing 18 is indicated with a dashed line. The housing 18 includes a linear displacement path 31*a* for the displaceable support of the entrainment member 14, and a bend 31*b* adjoining the linear displacement path 31*a*. The bend 31*b* is provided for releasably locking the entrainment member 14 in a pre-stressed parking position. The entrainment member 14 is thus movably arranged along the linear displacement path 31*a* between the shown parking position, in which the spring device 17 is tensioned, and a retracted end position, in which the spring device 17 is substantially relaxed. The entrainment member 14 includes a guide pin 14*a* by which the entrainment member 14 is displaceably guided along the bend 31*b* and along the linear displacement path 31*a*. Moreover, the entrainment member 14, for releasably coupling to the movable furniture part 3, has a notch 32 adapted to be coupled to a coupling peg arranged on the movable furniture part 3. At the end of the closing movement of the movable furniture part 3, the coupling peg moves into the notch 32, so that the entrainment member 14 is tilted out from the shown parking position and is retracted in the retracting direction 22 by the force of the relaxing spring device 17. The entrainment member 14 is pivotally connected to the holding device 16 by the hinge axis 15, and a guide element 33 arranged on the holding device 16 is displaceably arranged along a guide 18*a* of the housing 18. For dampening the spring-assisted retraction movement, a damping device 19 with a fluid chamber 20 is provided, and the ram 21, upon a movement of the entrainment member 14 in the retracting direction 22, moves into the fluid chamber 20 and the movement of the entrainment member 14 is dampened by a damping fluid arranged within the fluid chamber 20. When the force exertion applied to the entrainment member 14 in the retraction direction 22 is exceeded, the ram 21 is moved through an opening 24 (see FIG. 2) and can move into the bypass channel 27, so that the entrainment member 14 is decoupled from the ram 21. When a force applied to the entrainment member 14 in a direction opposite the retraction direction 22 exceeds a threshold value, the coupling portion 29 of the ram 21 is moved through a further opening 25 (see FIG. 2) of the holding device 16, so that the entrainment member 14, upon an unduly large pulling force applied to the movable furniture part 3, can also be decoupled from the ram 21. FIG. 3*b* shows the furniture drive 13 shown in FIG. 3*a* in a perspective view.

Figure 4A:
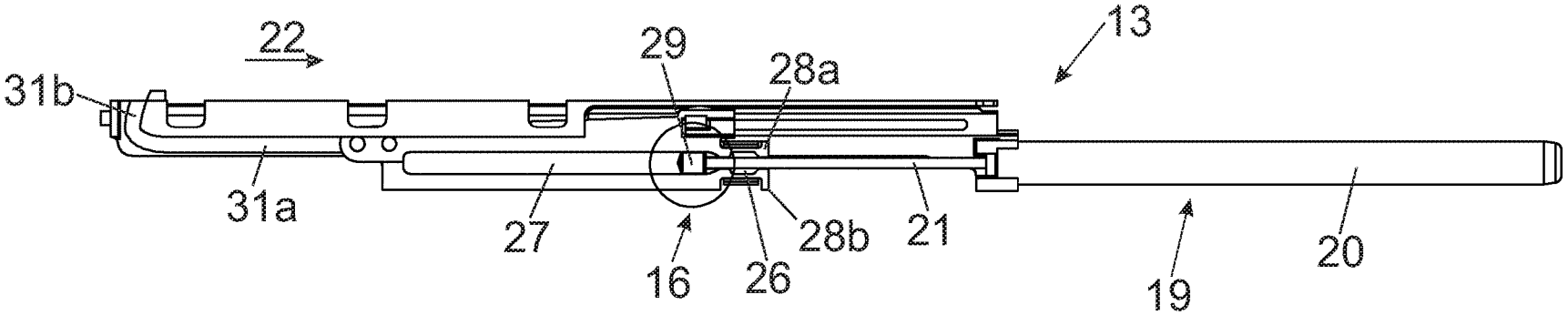
FIG. 4*a*, 4*b* are a side view of the furniture drive, in which the ram can be decoupled from the entrainment member when a force exertion applied to the entrainment member in a retraction direction is exceeded, and an enlarged detail view thereof.
Figure 4B:
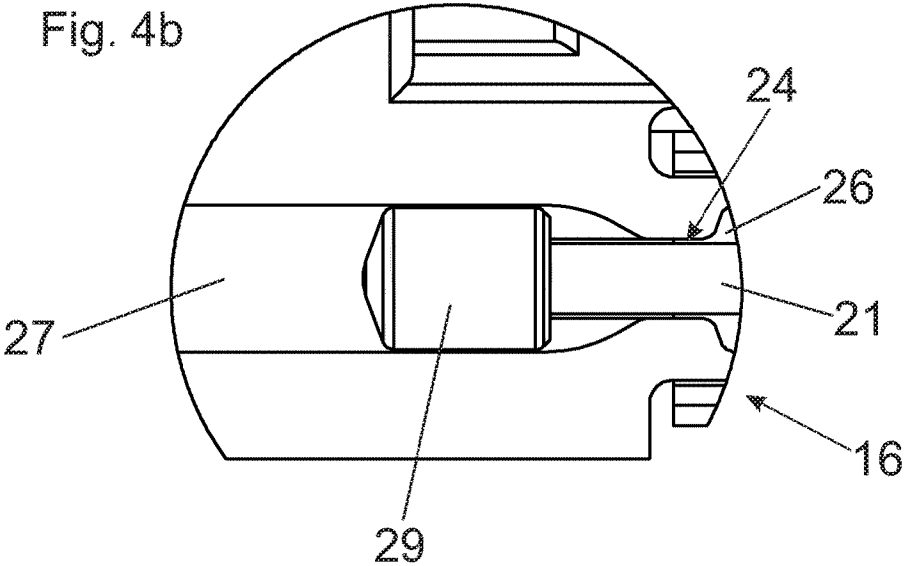

FIG. 4*a* shows the furniture drive 13 in a side view, in which, when a force applied to the entrainment member 14 in the retraction direction 22 exceeds a threshold value, the ram 21 is decoupled from the entrainment member 14. Due to this unduly large force exertion applied to the entrainment member 14 in the retraction direction 22, the coupling portion 29 of the ram 21 has been pushed from the receiving chamber 26 through the opening 24 into the bypass channel 27 of the holding device 16. Therefore, the entrainment member 14, without a further relative movement between the ram 21 and the fluid chamber 20, can be moved further in the retraction direction 22. By applying a manual pulling force to the movable furniture part 3, the coupling portion 29 of the ram 21 can again be coupled to (placed in) the receiving chamber 26 of the holding device 16. FIG. 4*b* shows the region encircled in FIG. 4*a* in an enlarged view.

Figure 5A:
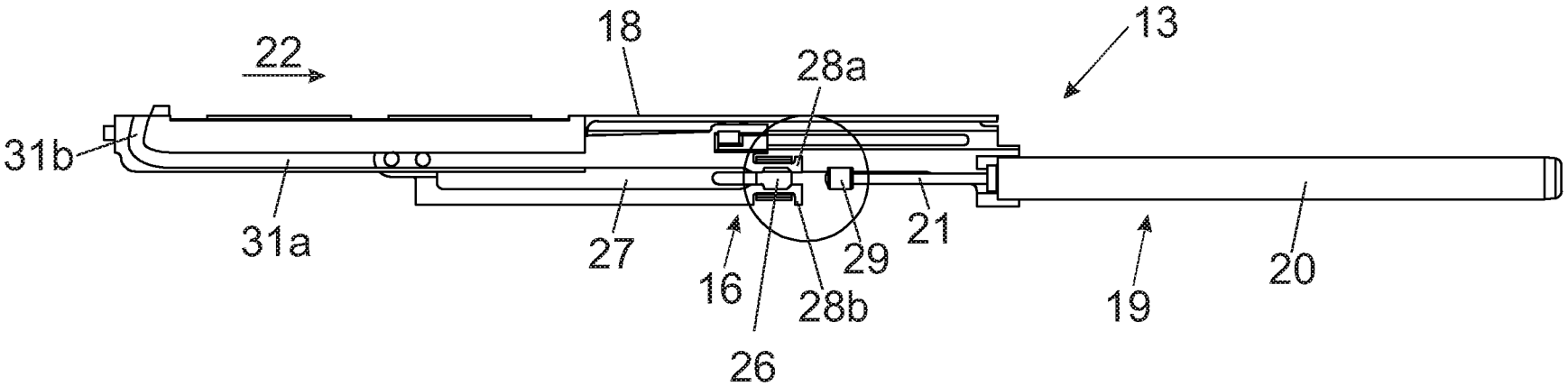
FIG. 5*a*, 5*b* are a side view of the furniture drive, in which the ram can be decoupled from the entrainment member when a force exertion applied to the entrainment member in a direction opposite the retraction direction is exceeded, and an enlarged detail view thereof.
Figure 5B:
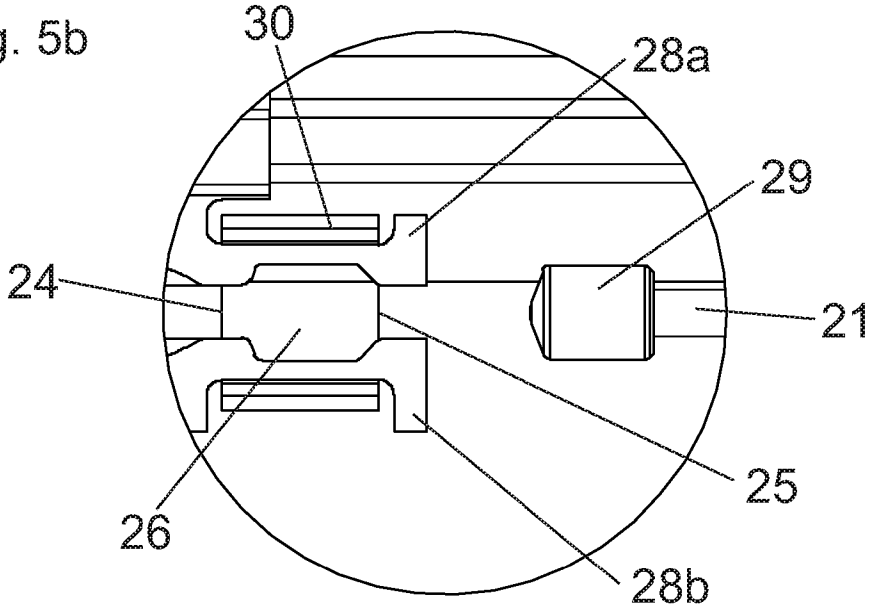

FIG. 5*a* shows the furniture drive 13 in a side view, in which the ram 21, when a force exertion applied to the entrainment member 14 in a direction opposite the retraction direction 22 is exceeded, is decoupled from the entrainment member 14. Due to this unduly large force exertion applied to the entrainment member 14 in a direction opposite the retraction direction 22, the coupling portion 29 of the ram 21 has been moved from the receiving chamber 26 through a further opening 25 into an open space present laterally besides the receiving chamber 26. Therefore, the entrainment member 14, without a further relative movement between the ram 21 and the fluid chamber 20, can further be moved in a direction opposite the retraction direction 22 (i.e. in a direction towards the parking position). By applying a manual pushing force to the movable furniture part 3, the coupling portion 29 of the ram 21 can again be coupled to the receiving chamber 26 of the holding device 16. FIG. 5*b* shows the region encircled in FIG. 5*a* in an enlarged view.

In the shown embodiment, the two holding elements 28*a*, 28*b* are acted upon by an energy storage member 30, and the energy storage member 30 can be formed by a mechanical spring element or also by an intrinsic elasticity of the holding elements 28*a*, 28*b*. The holding elements 28*a*, 28*b* are configured to be deformable or bendable in a direction transverse to the longitudinal direction of the ram 21 when a predetermined force applied to the entrainment member 14 is exceeded, so that the entrainment member 14 can be decoupled from the ram 21. It is also possible that the elastic pre-stressing of the holding elements 28*a*, 28 can be adapted so as to be adjustable in a direction towards the coupling portion 29. This, for example, can be effected by an adjusting screw (not shown here), and by rotating the adjusting screw, the pre-stressing of the energy storage member 30 and therewith the releasing force of the holding elements 28*a*, 28*b* can be adjusted.

In the shown embodiments, the damping device 19 includes a piston rod displaceable relative to the fluid chamber 20, and the ram 21 is formed by the piston rod. In a kinematic reversal, it is also possible to support the free end of the piston rod in a stationary manner in the mounting position, so that the fluid chamber 20 (i.e. the damping cylinder), for performing a damping hub, can be displaced relative to the stationary piston rod. In this case, the ram 21 is formed by the damping cylinder.

The invention claimed is:

1. A furniture drive for retracting a movably-supported furniture part into a closed end position relative to a furniture carcass, the furniture drive comprising:

an entrainment member for retracting the movable furniture part, wherein the entrainment member is displaceably arranged along a linear displacement path and is releasably coupled to the movable furniture part;

a spring device for applying a force to the entrainment member in a retracting direction;

a damping device for dampening a movement of the entrainment member in the retracting direction, wherein the damping device includes a fluid chamber and a ram displaceably arranged relative to the fluid chamber;

a holding device arranged between the ram and the entrainment member, wherein the holding device holds the ram relative to the entrainment member;

wherein the ram, the entrainment member, and the holding device are configured such that, when the force applied to the entrainment member in the retracting direction exceeds a threshold value, the ram moves through an opening of the holding device so as to decouple the entrainment member from the ram.

2. The furniture drive according to claim 1, wherein the opening of the holding device is a first opening, and wherein the ram, the entrainment member, and the holding device are further configured such that, when a force applied to the entrainment member in a direction opposite the retracting direction exceeds a threshold value, the ram moves through a second opening of the holding device so as to decouple the entrainment member from the ram.

3. The furniture drive according to claim 1, wherein the holding device includes at least one holding element configured to hold the ram relative to the holding device below a predetermined force threshold value applied to the entrainment member, and configured to allow a destruction-free translational movement of the ram relative to the entrainment member above the predetermined force threshold value applied to the entrainment member.

4. The furniture drive according to claim 3, further comprising an energy storage member for acting upon the at least one holding element.

5. The furniture drive according to claim 4, wherein the energy storage member comprises a mechanical spring element.

6. The furniture drive according to claim 3, wherein the at least one holding element is configured to be deformable or bendable in a direction transverse to the longitudinal direction of the ram above a predetermined force threshold value applied to the entrainment member, so that so as to allow decoupling of the entrainment member from the ram.

7. The furniture drive according to claim 3, wherein the holding device includes at least two holding elements for holding the ram.

8. The furniture drive according to claim 1, wherein the holding device is pivotally connected to the entrainment member by a hinge axis.

9. The furniture drive according to claim 1, wherein the holding device has a bypass channel into which the ram can be moved when the force applied to the entrainment member exceeds the threshold value.

10. The furniture drive according to claim 9, wherein the bypass channel has a longitudinal direction extending coaxially to a longitudinal direction of the ram.

11. The furniture drive according to claim 1, wherein the ram has a free end with a coupling portion thereon, wherein the coupling portion is held in a receiving chamber of the holding device when a force applied to the entrainment member is below the threshold value.

12. The furniture drive according to claim 1, wherein the furniture drive has a housing with a guide, wherein the holding device is displaceably arranged relative to the housing along the guide.

13. The furniture drive according to claim 12, wherein the holding device has a guide element displaceably arranged along the guide of the housing.

14. The furniture drive according to claim 1, wherein the ram is a piston rod displaceably arranged relative to the fluid chamber.

15. A drawer pull-out guide comprising:

a carcass rail to be fixed to a furniture carcass;

an extension rail displaceably arranged relative to the carcass rail between a closed position and an open position; and the furniture drive according to claim 1 for retracting the extension rail into the closed position.

16. The furniture drive according to claim 4, wherein the energy storage member is formed of an intrinsic elasticity of the at least one holding element.

17. The furniture drive according to claim 1, wherein the ram, the entrainment member, and the holding device are further configured such that, after the entrainment member has been decoupled from the ram, the ram can again be coupled to the holding device by moving the ram through the opening of the holding device in a direction opposite to a movement direction of the ram though the opening when the ram is decoupled from the entrainment member.

* * * * *